US010340064B2

(12) United States Patent
Deng et al.

(10) Patent No.: US 10,340,064 B2
(45) Date of Patent: Jul. 2, 2019

(54) RARE EARTH PERMANENT MAGNETIC MATERIAL AND METHOD OF PREPARING THE SAME

(71) Applicant: BYD COMPANY LIMITED, Shenzhen, Guangdong (CN)

(72) Inventors: Xiaoxia Deng, Shenzhen (CN); Bo Chen, Shenzhen (CN); Failang Zhang, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 379 days.

(21) Appl. No.: 15/192,246

(22) Filed: Jun. 24, 2016

(65) Prior Publication Data

US 2016/0307676 A1 Oct. 20, 2016

Related U.S. Application Data

(63) Continuation of application No. PCT/CN2014/092306, filed on Nov. 26, 2014.

(30) Foreign Application Priority Data

Dec. 27, 2013 (CN) ..... 2013 1 0740581

(51) Int. Cl.

| | |
|---|---|
| ***H01F 1/057*** | (2006.01) |
| ***B22F 3/24*** | (2006.01) |
| ***B22F 9/04*** | (2006.01) |
| ***H01F 1/055*** | (2006.01) |
| ***H01F 41/02*** | (2006.01) |
| ***C22C 1/02*** | (2006.01) |
| ***C22C 28/00*** | (2006.01) |
| ***C22C 33/04*** | (2006.01) |
| ***C22C 38/00*** | (2006.01) |
| ***C22C 38/06*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***B22D 7/00*** | (2006.01) |
| ***B22F 3/16*** | (2006.01) |
| ***C22C 30/02*** | (2006.01) |
| ***C22C 30/04*** | (2006.01) |
| ***B22F 9/02*** | (2006.01) |
| *C22C 33/02* | (2006.01) |

(52) U.S. Cl.

CPC ..... *H01F 1/0557* (2013.01); *B22D 7/00* (2013.01); *B22F 3/16* (2013.01); *B22F 3/24* (2013.01); *B22F 9/023* (2013.01); *B22F 9/04* (2013.01); *C22C 1/02* (2013.01); *C22C 28/00* (2013.01); *C22C 30/02* (2013.01); *C22C 30/04* (2013.01); *C22C 33/04* (2013.01); *C22C 38/002* (2013.01); *C22C 38/005* (2013.01); *C22C 38/008* (2013.01); *C22C 38/06* (2013.01); *C22C 38/10* (2013.01); *C22C 38/12* (2013.01); *C22C 38/14* (2013.01); *C22C 38/16* (2013.01); *H01F 1/057* (2013.01); *H01F 1/0577* (2013.01); *H01F 41/0273* (2013.01); *B22F 2003/248* (2013.01); *B22F 2009/044* (2013.01); *B22F 2202/05* (2013.01); *B22F 2301/355* (2013.01); *B22F 2304/10* (2013.01); *B22F 2998/10* (2013.01); *B22F 2999/00* (2013.01); *C22C 33/02* (2013.01); *C22C 33/0278* (2013.01); *C22C 2202/02* (2013.01)

(58) Field of Classification Search

None

See application file for complete search history.

(56) References Cited

U.S. PATENT DOCUMENTS

| | | | |
|---|---|---|---|
| 5,049,208 | A | 9/1991 | Yajima et al. |
| 2002/0007875 | A1 | 1/2002 | Yamamoto et al. |

FOREIGN PATENT DOCUMENTS

| | | | | |
|---|---|---|---|---|
| CN | 1819075 | A | | 8/2006 |
| CN | 200810019081.4 | | | 1/2008 |
| CN | 200810060360.5 | | | 4/2008 |
| CN | 101178963 | A | * | 5/2008 |
| CN | 101320609 | A | * | 12/2008 |
| CN | 200910091130.X | | | 8/2009 |
| CN | 201210578663.2 | | | 5/2012 |

(Continued)

OTHER PUBLICATIONS

Machine translation of CN-101178963-A (Year: 2008).*

(Continued)

*Primary Examiner* — Xiaowei Su

(74) *Attorney, Agent, or Firm* — Anova Law Group, PLLC

(57) ABSTRACT

A rare earth permanent magnetic material contains a main phase of $R1_{x1}R2_{y1}Fe_{1-x1-y1-z1-u1}Co_{z1}B_{u1}$, and an auxiliary phase including a first auxiliary phase of $R3_{x2}R4_{y2}Fe_{1-x2-y2-z2-u2-v1}Co_{z2}B_{u2}M_{v1}$ and a second auxiliary of $R5_{x3}R6_{y3}Fe_{1-x3-y3-z3-u3-v2}Co_{z3}B_{u3}M_{v2}$. Each of R1, R3 and R5 is Pr and/or Nd. Each of R2, R4 and R6 is at least one of Dy, Tb and Ho. M is at least one of Zr, Ga, Cu, Nb, Sn, Mo, Al, V, W, Si, Hf, Ti, Zn, Bi, Ta and In. 26 wt %≤x1+y1≤34 wt %, 0.01 wt %≤y1≤4 wt %, 0≤z1≤6 wt %, and 0.78 wt %≤u1≤1.25 wt %. 35 wt %≤x2+y2≤82 wt %, 5 wt %≤y2≤42 wt %, 0≤z2≤40 wt %, 0≤u2≤1.25 wt %, and 0≤v1≤10 wt %. 10 wt %≤x3+y3≤32 wt %, 0≤y3≤4.8 wt %, 0≤z3≤40 wt %, 0≤u3≤1.25 wt %, and 31 wt %≤v2≤50 wt %.

8 Claims, No Drawings

(56) References Cited

FOREIGN PATENT DOCUMENTS

| | | | |
|---|---|---|---|
| CN | 201210159470.3 | | 12/2012 |
| CN | 103426578 | A | 12/2013 |
| CN | 200580042529.9 | | 12/2015 |
| EP | 0517355 | A1 | 12/1992 |
| JP | 2002-057052 | A | 2/2002 |
| JP | 2006-100434 | A | 4/2006 |
| JP | 2013219322 | | 1/2013 |
| WO | WO 2015/096583 | A1 | 7/2015 |
| WO | WO 2013/146781 | | 12/2015 |

OTHER PUBLICATIONS

Machine translation of CN-101320609-A (Year: 2008).*
PCT International Search Report and Written Opinion dated Feb. 27, 2015, issued in corresponding International Application No. PCT/CN2014/092306 (14 pages).

* cited by examiner

RARE EARTH PERMANENT MAGNETIC MATERIAL AND METHOD OF PREPARING THE SAME

CROSS-REFERENCE TO RELATED APPLICATION

This application is a continuation of International Application No. PCT/CN2014/092306, filed on Nov. 26, 2014, which claims priority to and benefits of Chinese Patent Application No. 201310740581.8, filed with the State Intellectual Property Office of P. R. C. on Dec. 27, 2013, the entire contents of these applications are incorporated herein by reference.

FIELD

Exemplary embodiments of the present disclosure relate generally to a rare earth permanent magnetic material field, and more particularly to a rare earth permanent magnetic material and a method of preparing the rare earth permanent magnetic material.

BACKGROUND

As compared with other permanent magnetic material, sintered NdFeB permanent magnetic material has some outstanding advantages such as high magnetic property and low cost, so that it has been widely developed and applied. At present, sintered NdFeB permanent magnetic material has been applied in many fields due to a relative higher comprehensive magnetic property.

However, new energy and environmental protection have obtained increased concern and become a developing trend, and a permanent magnetic material with a high coercivity and a high remanence is required. A permanent magnetic material with a high coercivity needs relative more expensive elements dysprosium and/or terbium. But if too much such elements are added, neither the requirement of high remanence can be meet, nor the light weight of motor and high availability of electric energy and wind energy can be obtained.

The coercivity of prepared permanent magnet material at present has a significant difference from a theoretical limit 80 kOe, and a relative high content of Dy and/or Tb is needed in order to improve the coercivity of the permanent magnet material at present. In addition, when the coercivity of the permanent magnet material is increased, the remanence may be decreased. Therefore, it is required to improve the coercivity with only a small decrease of the remanence of the permanent magnetic material by using a small amount of Dy and/or Tb.

SUMMARY

Embodiments of the present disclosure seek to solve at least one of the problems.

According to a first aspect of the present disclosure, a rare earth permanent magnetic material is provided. The rare earth permanent magnetic material includes: a main phase represented by $R1_{x1}R2_{y1}Fe_{1-x1-y1-z1-u1}Co_{z1}B_{u1}$, where R1 is at least one element selected from Pr and Nd; R2 is at least one element selected from the group consisting of Dy, Tb and Ho; x1, y1, z1 and u1 are weight percents, $26\% \le x1+y1 \le 34\%$, $0.01\% \le y1 \le 4\%$, $0 \le z1 \le 6\%$, and $0.78\% \le u1 \le 1.25\%$; and an auxiliary phase separated from or cladding the main phase, and including a first auxiliary phase and a second auxiliary, in which the first auxiliary phase is represented by $R3_{x2}R4_{y2}Fe_{1-x2-y2-z2-u2-v1}Co_{z2}B_{u2}M_{v1}$, where R3 is at least one element selected from Pr and Nd; R4 is at least one element selected from the group consisting of Dy, Tb and Ho; M is at least one element selected from the group consisting of Zr, Ga, Cu, Nb, Sn, Mo, Al, V, W, Si, Hf, Ti, Zn, Bi, Ta and In; x2, y2, z2, u2 and v1 are weight percents, $35\% \le x2+y2 \le 82\%$, $5\% \le y2 \le 42\%$, $0 \le z2 \le 40\%$, $0 \le u2 \le 1.25\%$, and $0 \le v1 \le 10\%$; and the second auxiliary phase is represented by $R5_{x3}R6_{y3}Fe_{1-x3-y3-z3-u3-v2}Co_{z3}B_{u3}M_{v2}$, where R5 is at least one element selected from Pr and Nd; R6 is at least one element selected from the group consisting of Dy, Tb and Ho; M is at least one element selected from the group consisting of Zr, Ga, Cu, Nb, Sn, Mo, Al, V, W, Si, Hf, Ti, Zn, Bi, Ta and In; x3, y3, z3, u3 and v2 are weight percents, $10\% \le x3+y3 \le 32\%$, $0 \le y3 \le 4.8\%$, $0 \le z3 \le 40\%$, $0 \le u3 \le 1.25\%$, and $31\% \le v2 \le 50\%$.

According to a second aspect of the present disclosure, a method of preparing the rare earth permanent magnetic material is provided. The method of preparing the rare earth permanent magnetic material includes: smelting metals contained in the main phase and molding the melt metals into an ingot or molding the melt metals into an alloy sheet via a quick-setting process to obtain a first alloy of the main phase; smelting metals contained in the first auxiliary phase and molding the melt metals into an ingot or molding the melt metals into an alloy sheet via a quick-setting process to obtain a second alloy of the first auxiliary phase; smelting metals contained in the second auxiliary phase and molding the melt metals into an ingot or molding the melt metals into an alloy sheet via a quick-setting process to obtain a third alloy of the second auxiliary phase; and powdering, mixing, forming, and sintering the first, second and third alloys.

As compared with a rare earth permanent magnetic material in the related art, the rare earth permanent magnetic material according to embodiments of the present disclosure may have a relative higher coercivity, with a small amount of the remanence decrease and a small amount of dysprosium and/or terbium. Further, a production cost of the rare earth permanent magnetic material may be reduced.

Additional aspects and advantages of embodiments of present disclosure will be given in part in the following descriptions, become apparent in part from the following descriptions, or be learned from the practice of the embodiments of the present disclosure.

DETAILED DESCRIPTION

Reference will be made in detail to embodiments of the present disclosure. The embodiments described herein with reference to drawings are explanatory, illustrative, and used to generally understand the present disclosure. The embodiments shall not be construed to limit the present disclosure.

In the description, terms such as "first" and "second" are used herein for purposes of description and are not intended to indicate or imply relative importance or significance. In addition, for the purpose of the present description and of the following claims, the definitions of the numerical ranges always include the extremes unless otherwise specified.

In some embodiments of the present disclosure, a rare earth permanent magnetic material is provided. The rare earth permanent magnetic material includes a main phase and an auxiliary phase separated from or cladding the main phase. The auxiliary phase contains a first auxiliary phase and a second auxiliary phase.

In some embodiments, the main phase has a composition represented by a formula $R1_{x1}R2_{y1}Fe_{1-x1-y1-z1-u1}Co_{z1}B_{u1}$, where R1 is at least one element selected from Pr and Nd; R2 is at least one element selected from the group consisting of Dy, Tb and Ho; and x1, y1, z1 and u1 are weight percents of corresponding elements respectively, 26%≤x1+y1≤34%, 0.01%≤y1≤4%, 0≤z1≤6%, and 0.78%≤u1≤1.25%.

In some embodiments, the first auxiliary phase has a composition represented by a formula $R3_{x2}R4_{y2}Fe_{1-x2-y2-z2-u2-v1}Co_{z2}B_{u2}M_{v1}$, where R3 is at least one element selected from Pr and Nd; R4 is at least one element selected from the group consisting of Dy, Tb and Ho; M is at least one element selected from the group consisting of Zr, Ga, Cu, Nb, Sn, Mo, Al, V, W, Si, Hf, Ti, Zn, Bi, Ta and In; and x2, y2, z2, u2 and v1 are weight percents of corresponding elements respectively, 35%≤x2+y2≤82%, 5%≤y2≤42%, 0≤z2≤40%, 0≤u2≤1.25%, and 0≤v1≤10%.

In some embodiments, the second auxiliary phase has a composition represented by a formula of $R5_{x3}R6_{y3}Fe_{1-x3-y3-z3-u3-v2}Co_{z3}B_{u3}M_{v2}$, where R5 is at least one element selected from Pr and Nd; R6 is at least one element selected from the group consisting of Dy, Tb and Ho; M is at least one element selected from the group consisting of Zr, Ga, Cu, Nb, Sn, Mo, Al, V, W, Si, Hf, Ti, Zn, Bi, Ta and In; and x3, y3, z3, u3 and v2 are weight percents of corresponding elements respectively, 10%≤x3+y3≤32%, 0≤y3≤4.8%, 0≤z3≤40%, 0≤u3≤1.25%, and 31%≤v2≤50%.

According to some embodiments of the present disclosure, the rare earth permanent magnetic material contains the main phase, the first auxiliary phase having a relative higher content of Dy and/or Tb, and the second auxiliary phase having a relative higher content of metals with low melting point, and therefore a loss of magnetic induction intensity of the final magnet (i.e. the rare earth permanent magnetic material) may be reduced and a high coercivity may be obtained with a relative small loss of magnetic induction.

In the related art, if using rare earth elements only consisting of Pr and/or Nd, it may be hard to obtain a magnet with high coercivity which can be operated at high temperature, such as magnets used in a motor of a vehicle, a wind driven generator, etc. It has been suggested to include elements such as Dy and/or Tb to increase the coercivity of the magnet, however, it causes an avoidable decrease in the remanence and an increase in the manufacturing cost.

The inventors of the present disclosure has found, by using the first auxiliary phase and the second auxiliary phase described above, the rare earth permanent magnetic material according to embodiments of the present disclosure may have relatively higher coercivity with relatively less magnetic induction loss. Although Dy and/or Tb exists in the first auxiliary phase, the Dy and/or Tb has a small content and may react with elements in the second auxiliary phase. Therefore, the rare earth permanent magnetic material according to embodiments of the present disclosure can still have high coercivity with less magnetic induction loss. In addition, compared with a conventional rare earth permanent magnetic material, the rare earth permanent magnetic material according to embodiments of the present disclosure may have a reduced Dy and/or Tb content.

In some embodiments of the present disclosure, based on the total weight of the main phase and the auxiliary phase, the amount of the first auxiliary C1 satisfies: 0<C1≤25 wt %. Further, based on the total weight of the main phase and the auxiliary phase, the amount of the first auxiliary satisfies: 0<C1≤15 wt %. Therefore, the coercivity and remanence of the rare earth permanent magnetic material may be further improved.

In some embodiments of the present disclosure, based on the total weight of the main phase and the auxiliary phase, the amount of the second auxiliary satisfies: 0<C2≤20 wt %. Further, based on the total weight of the main phase and the auxiliary phase, the amount of the second auxiliary satisfies: 0<C2≤10 wt %.

In some embodiments of the present disclosure, in the composition of the main phase, x1, y1, z1 and u1 satisfy: 27%≤x1+y1≤33%, 1%≤y1≤4%, 1%≤z1≤3%, and 0.8%≤u1≤1.1%. With the composition and composition amount described above, the rare earth permanent magnetic material may have a relative high coercivity with a relative small decrease of remanence.

In some embodiments of the present disclosure, in the composition of the first auxiliary phase, x2, y2, z2, u2 and v1 satisfy: 37%≤x2+y2≤68%, 9%≤y2≤26%, 0≤z2≤18%, 0≤u2≤1.1%, and 0≤v1≤8%. With the composition and composition amount described above, the rare earth permanent magnetic material may have a relative high coercivity with a relative small decrease of remanence.

In some embodiments of the present disclosure, in the composition of the second auxiliary phase, x3, y3, z3, u3 and v2 satisfy: 10%≤x3+y3≤30%, 0≤y3≤4%, 5%≤z3≤18%, 0≤u3≤1.1%, and 31%≤v2≤48%. With the composition and composition amount described above, the rare earth permanent magnetic material may have a relative high coercivity with a relative small decrease of remanence.

According to some embodiments of the present disclosure, a method of preparing the rare earth permanent magnetic material is provided. The method of preparing the rare earth permanent magnetic material includes: smelting metals contained in the main phase and molding the melt metals into an ingot or molding the melt metals into an alloy sheet via a quick-setting process to obtain a first alloy of the main phase; smelting metals contained in the first auxiliary phase and molding the melt metals into an ingot or molding the melt metals into an alloy sheet via a quick-setting process to obtain a second alloy of the first auxiliary phase; smelting metals contained in the second auxiliary phase and molding the melt metals into an ingot or molding the melt metals into an alloy sheet via a quick-setting process to obtain a third alloy of the second auxiliary phase; and powdering, mixing, forming, and sintering the first, second and third alloys.

According to some embodiments of the present disclosure, each of the first, second and third alloy may be obtained by melting metals contained in respective alloys and molding the melt metals, for example, molding the melt metals into an ingot or an alloy sheet.

In some embodiments, the first alloy may be obtained with the following steps: melting metals contained in the main phase and having corresponding weight percents as described, and molding the melt metals into an ingot. In some embodiments, the first alloy may be obtained with the following steps: melting metals contained in the main phase and having corresponding weight percents as described, and molding the melt metals into an alloy sheet via a quick-setting process.

In some embodiments, the second alloy may be obtained with the following steps: melting metals contained in the first auxiliary phase and having corresponding weight percents as described, and molding the melt metals into an ingot. In some embodiments, the second alloy may be obtained with the following steps: melting metals contained in the first auxiliary phase and having corresponding weight percents as described, and molding the melt metals into an alloy sheet via a quick-setting process.

In some embodiments, the third alloy may be obtained with the following steps: melting metals contained in the second auxiliary phase and having corresponding weight percents as described, and molding the melt metals into an ingot. In some embodiments, the third alloy may be obtained with the following steps: melting metals contained in the second auxiliary phase and having corresponding weight percents as described, and molding the melt metals into an alloy sheet via a quick-setting process.

In some embodiments, the forming is performed in a magnetic orientation field.

In some embodiments, the sintering is performed under vacuum or in the presence of an inert gas.

According to the method of preparing a rare earth permanent magnetic material of embodiments of the present disclosure, both a double alloy method (i.e., smelting raw materials of the main phase and raw materials of the auxiliary phase respectively to form the rare earth permanent magnetic material) and a single alloy method (i.e., smelting one alloy composition, such as raw materials of the main phase and the auxiliary phase, to obtain the rare earth permanent magnetic material containing the main phase and the auxiliary phase) may be suitable to prepare the rare earth permanent magnetic material according to embodiments of the present disclosure.

In some embodiments of the present disclosure, the method of preparing a rare earth permanent magnetic material may be a single alloy method. The single alloy method includes: smelting one alloy containing all compositions of the rare earth permanent magnetic material; molding the smelt alloy to form an ingot or a quick-setting alloy sheet; and crushing, powdering, and molding the ingot or the quick-setting alloy sheet.

In some embodiments of the present disclosure, the method of preparing a rare earth permanent magnetic material may be a double alloy method. The double alloy method includes: providing an alloy of the main phase by smelting metals contained in the main phase and molding the smelt metals into an ingot or a quick-setting alloy sheet; providing an alloy of the auxiliary phase by smelting metals contained in the auxiliary phase and molding the smelt metals into an ingot or a quick-setting alloy sheet; mixing, crushing, and powdering the ingot or the quick-setting alloy sheet of the main phase and the ingot or the quick-setting alloy sheet of the auxiliary phase to form powders; and forming the powders.

It should be noted that, in the embodiments of the present disclosure, there is no particular limit to the order of providing the alloy of the main phase and the alloy of the auxiliary phase. In some embodiments, the alloy of the main phase is provided first, and then the alloy of the auxiliary phase is provided. In some embodiments, the alloy of the auxiliary phase is provided first, and then the alloy of the main phase is provided.

It should be noted that, in embodiments of the present disclosure, there is no particular limit to the order of mixing, crushing and powdering the ingot or the quick-setting alloy sheet of the main phase and the ingot or the quick-setting alloy sheet of the auxiliary phase to form powders. In some embodiments, the order is mixing, crushing, and powdering in sequence. In some embodiments, the order is crushing, powdering and mixing in sequence. In some embodiments, the order is powdering, mixing, and crushing in sequence.

According to some embodiments of the present disclosure, the double alloy method may be adopted to prepare the rare earth permanent magnetic material. The double alloy method includes smelting raw materials (metals contained therein) of the main phase and raw materials (metals contained therein) of the auxiliary phase respectively before the forming step. The inventors of the present disclosure have found that, a rare earth permanent magnetic material prepared by the double alloy method may have improved performances. Elements contained in the auxiliary phase may react at the grain boundary, thus obtaining the main phase with a high anisotropy field and a rare earth rich phase. At the meantime, trace elements at the grain boundary of the auxiliary phase may improve the microstructure. In addition, the raw material of the auxiliary phase is added separately, thus Dy and/or Tb as well as trace elements in the raw material of the auxiliary phase may be positioned at the epitaxial layer and the grain boundary and prevented from entering the main phase. In some embodiments, compared with those prepared by the single alloy method, rare earth permanent magnetic material prepared by the double alloy method may have decreased content of Dy and/or Tb.

In some embodiments of the present disclosure, the step of smelting is known to those skilled in the art. The step of smelting is performed for about 20 minutes to 100 minutes at a temperature of about 1000° C. to about 1500° C. In some embodiments, after the smelting step, the smelt metals may be molded in the form of ingot or strip.

In some embodiments of the present disclosure, the step of crushing is any conventional crushing method known to those skilled in the art, provided the ingot or quick-setting alloy sheet of the main phase and the ingot or quick-setting alloy sheet of the auxiliary phase may be completely crushed. In some embodiment, the crushing is performed by hydrogen decrepitation. The condition of the hydrogen decrepitation may be known to those skilled in the art. In some embodiment, the hydrogen decrepitation includes a hydrogen absorption under a hydrogen pressure of about 0.06 MPa to about 1.5 MPa for about 0.1 hour to 3 hours at room temperature (20±5° C.), and a dehydrogenation at about 400° C. to about 650° C. for about 3 hours to 10 hours.

The method of powdering may be any conventional powdering methods known to those skilled in the art, provided a product obtained from the hydrogen decrepitation is processed into a powder with a suitable particle size. In some embodiments of the present disclosure, the powdering is performed by jet milling.

In some embodiments, the method of preparing the rare earth permanent magnetic material further includes adding an antioxidant into a product obtained from the crushing step, before the jet milling. The antioxidant may be any antioxidant suitable for NdFeB magnets, such as KM-01 antioxidant, commercially available from Juncefeng Technology Development Co Ltd, Beijing, China. Based on the total weight of a product obtained from the crushing step such as hydrogen decrepitation, the amount of the antioxidant is about 0.02 wt % to 0.17 wt %. With the jet milling, powders of the first, second and third alloy may have an average particle diameter ranging from 1.4 μm to 4.5 μm. In some embodiments, a double alloy method is applied, and powders from the main phase may have an average particle diameter ranging from 2.5 μm to 4.5 μm.

In some embodiments of the present disclosure, the method for preparing the rare earth permanent magnetic material further includes adding a lubricant into the powders of the first, second and third alloys before the mixing step. For example, a lubricant is added into the powders obtained from the powdering step. Based on the total weight of the powders obtained from the step of powdering, the amount of the lubricant is about 0.02 wt % to about 17 wt %. The lubricant is at least one selected from the group consisting of gasoline, oleic acid, stearic acid, polyethylene glycol, dehydrated sorbitol and stearin.

In some embodiments of the present disclosure, the step of forming may be any forming methods known to those skilled in the art. In some embodiments, the forming may be performed in a magnetic orientation field. In some embodiments, the magnetic orientation field includes a constant magnetic field of about 1.5 Tesla to 3.5 Tesla or a pulsed magnetic field of about 1.5 Tesla to 3.5 Tesla. In some embodiments, the forming step further includes maintaining a formed product under an isostatic pressure of about 160 MPa to about 220 MPa for about 45 seconds to about 120 seconds.

In some embodiments of the present disclosure, the step of sintering is known to those skilled in the art. In some embodiments, the sintering is performed under a sintering temperature of about 1040° C. to about 1100° C. for about 3 hours to about 6 hours.

In some embodiments, the method for preparing the rare earth permanent magnetic material may further include a tempering step after the sintering step. In some embodiments, the tempering includes a primary tempering performed at a temperature of about 870° C. to about 950° C. for about 2 hours to about 5 hours, and a secondary tempering performed under a temperature of about 480° C. to about 560° C. for about 3 hours to about 8 hours.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

Some illustrative and non-limiting examples are provided hereunder for a better understanding of the present invention and for its practical embodiment.

Embodiment 1

The present embodiment E1 provides a rare earth permanent magnetic material and a method of preparing the rare earth permanent magnetic material.

Raw materials of a compound $Pr_{7.5}Nd_{22}Dy_3Tb_{0.5}Fe_{64.5}Co_{1.5}B_1$ (main phase) were subjected to a strip casting process with a copper roller linear surface velocity of 1.6 m/s so as to form a strip. The strip was subjected to a hydrogen absorption under a hydrogen pressure of 0.12 MPa and at a temperature of 20° C. for 1.5 hours and a dehydrogenation at a temperature of 565° C. for 5.5 hours so as to form powders. Then, 100 weight parts of the powders and 0.06 weight parts of KM-01 antioxidant (dedicated to NdFeB, commercially available from Juncefeng Technology Development Co. Ltd., Beijing, China) were mixed together and jet milled to form fine powders having an average particle diameter of 3.3 μm. Then 100 weight parts of the fines powders were mixed with 0.02 parts of gasoline to form a main phase precursor.

Raw materials of an alloy $Pr_{10}Nd_{16}Dy_{22}Tb_2Fe_{29}Co_{13}B_1Al_4Cu_1Zr_1Ga_1$ (first auxiliary phase) were smelt at a temperature of 1310° C. for 24 minutes to form an ingot. The ingot was subjected to a hydrogen absorption under a hydrogen pressure of 0.12 MPa at a temperature of 20° C. for 1.5 hours, and a dehydrogenation at a temperature of 565° C. for 5.5 hours so as to form powders. 100 weight parts of the powders and 0.06 weight parts of KM-01 antioxidant (dedicated to NdFeB, commercially available from Juncefeng Technology Development Co. Ltd., Beijing, China) were mixed together and jet milled to form fine powders having an average particle diameter of 3.2 μm. Then 100 weight parts of the fine powders were mixed with 0.02 parts of gasoline to form a first auxiliary phase precursor.

Raw materials of an alloy $Pr_5Nd_{13}Dy_{1.5}Tb_{0.5}Fe_{27}Co_{18}Al_{15}Cu_7Zr_3Ga_2Nb_3Sn_5$ (second auxiliary phase) were smelt at a temperature of 1210° C. for 20 minutes to form an ingot. The ingot was subjected to a hydrogen absorption under a hydrogen pressure of 0.12 MPa at a temperature of 20° C. for 1.5 hours, and performed a dehydrogenation at a temperature of 565° C. for 5.5 hours to form powders. 100 weight parts of the powders and 0.06 weight parts of KM-01 antioxidant (dedicated to NdFeB, commercially available from Juncefeng Technology Development Co. Ltd., Beijing, China) were mixed together and jet milled to form fine powders having an average particle diameter of 3.0 μm. Then 100 weight parts of the fine powders were mixed with 0.02 weight parts of gasoline to form a second auxiliary phase precursor.

The above main phase precursor, the first auxiliary phase precursor and the second auxiliary phase precursor were mixed together to form a precursor mixture. Based on 100 weight parts of the sum of the main phase precursor, the first auxiliary phase precursor and the second auxiliary phase precursor, the amount of the first auxiliary phase precursor was 1.5 weight parts, and the amount of the second auxiliary phase precursor was 10 weight parts.

The precursor mixture was formed in a constant magnetic field of 2.5 T, and kept under an isostatic pressure of 200 MPa for 50 seconds. Then the formed product was sintered at a temperature of 1080° C. for 4 hours, primary tempered at a temperature of 920° C. for 2.5 hours, and secondary tempered at a temperature of 500° C. for 3 hours, thus obtaining a rare earth permanent magnetic material A1.

Comparative Embodiment 1

The present comparative embodiment CE1 provides a rare earth permanent magnetic material and a method of preparing the rare earth permanent magnetic material.

The method for preparing the present rare earth permanent magnetic material CA1 is substantially the same as that in Embodiment 1, with the exception that raw materials of the main phase were not added, and thus no main phase was contained in the rare earth permanent magnetic material CA1.

Embodiment 2

The present embodiment E2 provides a rare earth permanent magnetic material and a method of preparing the rare earth permanent magnetic material.

The method for preparing the rare earth permanent magnetic material A2 is substantially the same as that in Embodiment 1, with the following exceptions.

Based on 100 weight parts of the sum of the main phase precursor, the first auxiliary phase precursor and the second auxiliary phase precursor, the amount of the first auxiliary phase precursor was 5 weight parts, and the amount of the second auxiliary phase precursor was 7 weight parts. In addition, the total composition of the main phase, the first auxiliary phase and the second auxiliary phase was represented by a formula $Pr_{7.45}Nd_{21.07}Dy_{3.84}Tb_{0.57}Fe_{60.1}Co_{3.23}B_{0.93}Al_{1.25}Cu_{0.54}Zr_{0.26}Ga_{0.19}Nb_{0.21}Sn_{0.35}$.

Embodiment 3

The present embodiment E3 provides a rare earth permanent magnetic material and a method of preparing the rare earth permanent magnetic material.

Contents of raw materials of the main phase, the first auxiliary phase, and second auxiliary phase referred to those in Embodiment 2 (i.e., Pr, Nd, Dy, Tb, Fe, Co, B, Al, Cu, Zr, Ga, Nb and Sn), and the method for preparing the rare earth permanent magnetic material A3 referred to the method of preparing the rare earth permanent magnetic material from the main phase as described in Embodiment 1 (for example, single alloy method). The total composition of the main phase, the first auxiliary phase and the second auxiliary phase was represented by a formula $Pr_{7.17}Nd_{20}Dy_{5.2}Tb_{0.57}Fe_{60.1}Co_{3.23}B_{0.93}Al_{1.25}Cu_{0.54}Zr_{0.26}Ga_{0.19}Nb_{0.21}Sn_{0.35}$.

Embodiment 4

The present embodiment E4 provides a rare earth permanent magnetic material and a method of preparing the rare earth permanent magnetic material.

The method for preparing the rare earth permanent magnetic material A4 is substantially the same as that in Embodiment 1, with the exception that based on 100 weight parts of the total amount of the main phase precursor, the first auxiliary phase precursor and the second auxiliary phase precursor, the amount of the first auxiliary phase precursor was 15 weight parts, and the amount of the second auxiliary phase precursor was 1 weight part.

Embodiment 5

The present embodiment E5 provides a rare earth permanent magnetic material and a method of preparing the rare earth permanent magnetic material.

The method for preparing the rare earth permanent magnetic material A5 is substantially the same as that in Embodiment 1, with the exception that based on 100 weight parts of the total amount of the main phase precursor, the first auxiliary phase precursor and the second auxiliary phase precursor, the amount of the first auxiliary phase precursor was 0.1 weight parts, and the amount of the second auxiliary phase precursor was 11 weight parts.

Comparative Embodiment 2

The present comparative embodiment CE2 provides a rare earth permanent magnetic material and a method of preparing the rare earth permanent magnetic material.

The method for preparing the rare earth permanent magnetic material CA2 is substantially the same as that in Embodiment 1, with the following exceptions.

Dy in the raw materials of the auxiliary phase (i.e. the first and second auxiliary phases) was replaced with Pr and Nd. The composition of the first auxiliary phase was represented by a formula $Pr_{16}Nd_{34}Fe_{29}Co_{13}B_1Al_4Cu_1Zr_1Ga_1$ and the second auxiliary phase was represented by a formula $Pr_5Nd_{15}Fe_{27}Co_{18}Al_{15}Cu_7Zr_3Ga_2Nb_3Sn_5$.

Comparative Embodiment 3

The present comparative embodiment CE3 provides a rare earth permanent magnetic material and a method of preparing the rare earth permanent magnetic material.

The method for preparing the rare earth permanent magnetic material CA3 is substantially the same as that in Embodiment 1, with the following exceptions.

Dy in the raw materials of the auxiliary phase (i.e. the first and second auxiliary phases) was replaced with Pr and Nd. The composition of the first auxiliary phase was represented by a formula $Pr_{16}Nd_{34}Fe_{29}Co_{13}B_1Al_4Cu_1Zr_1Ga_1$ and the second auxiliary phase was represented by a formula $Pr_5Nd_{15}Fe_{27}Co_{18}Al_{15}Cu_7Zr_3Ga_2Nb_3Sn_5$. Based on 100 weight parts of the total amount of the main phase precursor, the first and second auxiliary phase precursors, the amount of the first auxiliary phase precursor was 5 weight parts, and the amount of the second auxiliary phase precursor was 7 weight parts.

Comparative Embodiment 4

The present comparative embodiment CE4 provides a rare earth permanent magnetic material and a method of preparing the rare earth permanent magnetic material.

The method for preparing the rare earth permanent magnetic material CA4 is substantially the same as that in Embodiment 1, with the following exceptions.

Dy in the raw materials of the auxiliary phase (i.e. the first and second auxiliary phases) was replaced with Pr and Nd. The composition of the first auxiliary phase was represented by a formula $Pr_{16}Nd_{34}Fe_{29}Co_{13}B_1Al_4Cu_1Zr_1Ga_1$ and the second auxiliary phase was represented by a formula $Pr_5Nd_{15}Fe_{27}Co_{18}Al_{15}Cu_7Zr_3Ga_2Nb_3Sn_5$. Based on 100 weight parts of the total amount of the main phase precursor, the first and second auxiliary phase precursors, the amount of the first auxiliary phase precursor was 15 weight parts, and the amount of the second auxiliary phase precursor was 1 weight part.

Embodiment 6

The present embodiment E6 provides a rare earth permanent magnetic material and a method of preparing the rare earth permanent magnetic material.

Raw materials of an alloy $Pr_5Nd_{18}Dy_{3.7}Tb_{0.3}Fe_{70.9}Co_1B_{1.1}$ (main phase) was subjected to a strip casting process with a copper roller linear surface velocity of 1.6 m/s so as to form a strip. The strip was subjected to a hydrogen absorption under a hydrogen pressure of 0.15 MPa at a temperature of 25° C. for 2 hours, and a dehydrogenation at a temperature of 560° C. for 5 hours to form powders. 100 weight parts of the powders and 0.05 weight parts of KM-01 antioxidant (dedicated to NdFeB, commercially available from Juncefeng Technology Development Co. Ltd., Beijing, China) were mixed together and jet milled to form fine powders having an average particle diameter of 3.4 μm. Then 100 weight parts of the fine powders were mixed with 0.03 weight parts of oleic acid to form a main phase precursor.

Raw materials of an alloy $Pr_{15}Nd_{25}Dy_{40}Ho_2Fe_{12}Co_1B_1Sn_4V_1Si_1Zn_1$ (first auxiliary phase) was smelt at a temperature of 1310° C. for 24 minutes so as to form an ingot. The ingot was subjected to a hydrogen absorption under a hydrogen pressure of 0.15 MPa at a temperature of 25° C. for 2 hours, and a dehydrogenation at a temperature of 560° C. for 5 hours to form powders. 100 weight parts of the powders and 0.05 weight parts of KM-01 antioxidant (dedicated to NdFeB, commercially available from Juncefeng Technology Development Co. Ltd., Beijing, China) were mixed together and jet milled to form fine powders having an average particle diameter of 3.1 μm. Then 100 weight parts of the fine powders were mixed with 0.03 parts of gasoline to form a first auxiliary phase precursor.

Raw materials of an alloy $Pr_{27.2}Dy_{2.8}Ho_2Fe_{28.75}Co_2B_{1.25}Zn_{15}Bi_{10}Ti_{10}Hf_1$ (second auxiliary phase) was smelt at a temperature of 1210° C. for 20 minutes to form an ingot. The ingot was subjected to a hydrogen absorption under a hydrogen pressure of 0.15 MPa at a temperature of 25° C. for 2 hours, and a dehydrogenation at a temperature of 560° C. for 5 hours to form powders. 100 weight parts of the powders and 0.05 weight parts of KM-01 antioxidant (dedicated to NdFeB, commercially available from Juncefeng Technology Development Co. Ltd., Beijing, China) were mixed together and jet milled to form fine powders having an average particle diameter of 3.15 μm. Then 100 weight parts of the fine powders were mixed with 0.03 parts of gasoline to form a second auxiliary phase precursor.

The above main phase precursor, first auxiliary phase precursor and second auxiliary phase precursor were mixed together to form a precursor mixture. Based on 100 weight parts of the total amount of the main phase precursor, the first auxiliary phase precursor and the second auxiliary phase precursor, the amount of the first auxiliary phase precursor was 17 weight parts, and the amount of the second auxiliary phase precursor was 11 weight parts.

The precursor mixture was formed in a constant magnetic field of 3 T, and kept for 60 seconds under an isostatic pressure of 190 MPa. Then the formed product was sintered at a temperature of 1085° C. for 3.5 hours, primary tempered under a temperature of 900° C. for 3 hours, and secondary tempered under a temperature of 520° C. for 3.5 hours, thus obtaining a rare earth permanent magnetic material A6.

Embodiment 7

The present embodiment E7 provides a rare earth permanent magnetic material and a method of preparing the rare earth permanent magnetic material.

Raw materials of an alloy $Pr_{10}Nd_{17}Tb_{1.5}Fe_{67.7}Co_3B_{0.8}$ (main phase) was subjected to a strip casting process with a copper roller linear surface velocity of 1.6 m/s to form a strip. The strip was subjected to a hydrogen absorption under a hydrogen pressure of 0.2 MPa at a temperature of 23° C. for 3 hours, and a dehydrogenation at a temperature of 550° C. for 6 hours to form powders. 100 weight parts of the powders and 0.04 weight parts of KM-01 antioxidant (dedicated to NdFeB, commercially available from Juncefeng Technology Development Co. Ltd., Beijing, China) were mixed together and jet milled to form fine powders having an average particle diameter of 3.5 μm. Then 100 weight parts of the fine powders were mixed with 0.04 weight parts of stearic acid to form a main phase precursor.

Raw materials of an alloy $Nd_{30}Tb_3Ho_2Fe_{13.75}Co_{40}B_{1.25}Mo_2W_2Hf_2Bi_2Ta_1In_1$ (first auxiliary phase) was smelt at a temperature of 1310° C. for 24 minutes to form an ingot. The ingot was subjected to a hydrogen absorption under a hydrogen pressure of 0.2 MPa at a temperature of 23° C. for 3 hours, and a dehydrogenation at a temperature of 550° C. for 6 hours to form powders. 100 weight parts of the powders and 0.04 weight parts of KM-01 antioxidant (dedicated to NdFeB, commercially available from Juncefeng Technology Development Co. Ltd., Beijing, China) were mixed together and jet milled to form a fine powders having an average particle diameter of 3.25 μm. Then 100 weight parts of the fine powders were mixed with 0.04 parts of gasoline to form a first auxiliary phase precursor.

Raw materials of an alloy $Nd_8Dy_1Tb_{0.5}Ho_{0.5}Fe_{17}Co_{40}B_1Mo_{10}V_{10}W_{10}Si_2$ (second auxiliary phase) was smelt at a temperature of 1210° C. for 20 minutes to form an ingot. The ingot was subjected to a hydrogen absorption under a hydrogen pressure of 0.2 MPa at a temperature of 23° C. for 3 hours, and a dehydrogenation at a temperature of 550° C. for 6 hours to form powders. 100 weight parts of the powders and 0.04 weight parts of KM-01 antioxidant (dedicated to NdFeB, commercially available from Juncefeng Technology Development Co. Ltd., Beijing, China) were mixed together and jet milled to form fine powders having an average particle diameter of 3.12 μm. Then 100 weight parts of the fine powders were mixed with 0.04 parts of gasoline to form a second auxiliary phase precursor.

The above main phase precursor, first auxiliary phase precursor and second auxiliary phase precursor were mixed together to form a precursor mixture. Based on 100 weight parts of the total amount of the main phase precursor, first auxiliary phase precursor and second auxiliary phase precursor, the amount of the first auxiliary phase precursor was 20 weight parts, and the amount of the second auxiliary phase precursor was 18 weight parts.

The precursor mixture was formed in a constant magnetic field of 3.5 T, and kept for 45 seconds under an isostatic pressure of 210 MPa. Then the formed product was sintered at a temperature of 1090° C. for 3 hours, primary tempered under a temperature of 930° C. for 2 hours, and secondary tempered under a temperature of 490° C. for 4 hours, thus obtaining a rare earth permanent magnetic material A7.

Embodiment 8

The present embodiment E8 provides a rare earth permanent magnetic material and a method of preparing the rare earth permanent magnetic material.

The method for preparing the rare earth permanent magnetic material A8 is substantially the same as that in Embodiment 1, with the following exceptions.

The composition of the first auxiliary phase was represented by a formula $Pr_6Nd_{20}Dy_{1.2}Tb_{0.2}Fe_{71.4}B_{1.2}$, the composition of the first auxiliary phase was represented by a formula $Pr_8Nd_{20}Dy_8Fe_{32.8}Co_{20}B_{1.2}Al_4Cu_4Zr_2$, and the second auxiliary phase was represented by a formula $Pr_1Nd_7Dy_{1.5}Fe_{36.3}Co_4B_{1.2}Al_{28}Cu_{15}Zr_2ASn_2Nb_2$. In addition, based on 100 weight parts of the total amount of the main phase precursor, the first auxiliary phase precursor and the second auxiliary phase precursor, the amount of the first auxiliary phase precursor was 20 weight parts, and the amount of the second auxiliary phase precursor was 15 weight parts.

Embodiment 9

The present embodiment E9 provides a rare earth permanent magnetic material and a method of preparing the rare earth permanent magnetic material.

The method for preparing the rare earth permanent magnetic material A9 is substantially the same as that in Embodiment 1, with the exception that the composition of main phase was $Pr_{25.99}Ho_{0.01}Fe_{66.75}Co_6B_{1.25}$, the composition of the first auxiliary phase was $Pr_3Nd_8Dy_{26}Fe_{37}Co_{18}Al_3Cu_2Ga_1Nb_2$ and the second auxiliary phase was $Pr_4Nd_{26}Fe_{24}Co_{15}B_1Al_{10}Cu_6Ga_2Nb_3Sn_9$.

Embodiment 10

The present embodiment E10 provides a rare earth permanent magnetic material and a method of preparing the rare earth permanent magnetic material.

The method for preparing the rare earth permanent magnetic material A10 is substantially the same as that in Embodiment 1, with the following exceptions.

The composition of the main phase was $Nd_{33}Dy_{0.5}Tb_{0.3}Ho_{0.2}Fe_{63.22}Co_2B_{0.78}$, the composition of the first auxiliary phase was $Pr_3Nd_8Dy_{26}Fe_{37}Co_{18}Al_3Cu_2Ga_1Nb_2$, and the second auxiliary phase was $Pr_5Nd_4Tb_{0.5}Ho_{0.5}Fe_{38}Co_1B_1V_{20}W_{10}Sn_{10}Ta_5In_5$. In addition, based on 100 weight parts of the total amount of the main phase precursor, the first auxiliary phase precursor and the second auxiliary phase precursor, the amount of the first auxiliary phase precursor was 20 weight parts, and the amount of the second auxiliary phase precursor was 13 weight parts.

Embodiment 11

The present embodiment E11 provides a rare earth permanent magnetic material and a method of preparing the rare earth permanent magnetic material.

Contents of raw materials of the main phase, the first auxiliary phase and the second auxiliary phase referred to those in Embodiment 10 (i.e., Nd, Dy, Tb, Ho, Fe, Pr, Co, B, Al, Cu, Zr, Ga, Nb, Sn, V, W, Ta and In), and the method for preparing the rare earth permanent magnetic material A11 referred to the method of preparing a rare earth permanent magnetic material from the main phase as described in Embodiment 1 (single alloy method). The total composition of the raw materials of the main phase, the first auxiliary phase and the second auxiliary phase was represented by a formula $Pr_{1.25}Nd_{24.23}Dy_{5.89}Tb_{0.35}Ho_{0.32}Fe_{54.14}Co_{5.07}B_{0.65}Al_{0.6}V_{2.6}W_{1.3}Sn_{1.3}Ga_{0.2}Ta_{0.65}Nb_{0.4}In_{0.65}Cu_{0.4}$.

Embodiment 12

The present embodiment E12 provides a rare earth permanent magnetic material and a method of preparing the rare earth permanent magnetic material.

The method for preparing the rare earth permanent magnetic material A12 is substantially the same as that in Embodiment 1, with the following exceptions.

The composition of the first auxiliary phase was $Pr_3Nd_8Dy_{26}Fe_{37}Co_{18}Al_3Cu_2Ga_1Nb_2$, and the second auxiliary phase was $Pr_4Nd_{26}Fe_{24}Co_{15}B_1Al_{10}Cu_6Ga_2Nb_3Sn_9$. Based on 100 weight parts of the total amount of the main phase precursor, the first auxiliary phase precursor and the second auxiliary phase precursor, the amount of the first auxiliary phase precursor was 15 weight parts, and the amount of the second auxiliary phase precursor was 1 weight part.

Embodiment 13

The present embodiment E13 provides a rare earth permanent magnetic material and a method of preparing the rare earth permanent magnetic material.

The method for preparing the rare earth permanent magnetic material A13 is substantially the same as that in Embodiment 1, with the exception that the composition of the first auxiliary phase was $Pr_{13}Nd_{46}Dy_7Tb_2Fe_{30.9}B_{1.1}$, and the second auxiliary phase was $Pr_1Nd_5Dy_4Fe_{35.9}Co_5B_{1.1}Al_{20}Cu_{10}Zr_5Ga_3Sn_{10}$.

Embodiment 14

The present embodiment E14 provides a rare earth permanent magnetic material and a method of preparing the rare earth permanent magnetic material.

The method for preparing the rare earth permanent magnetic material A14 is substantially the same as that in Embodiment 1, with the following exceptions.

The composition of the first auxiliary phase was $Pr_{13}Nd_{46}Dy_7Tb_2Fe_{30.9}B_{1.1}$, and the composition of the second auxiliary phase was $Pr_1Nd_5Dy_4Fe_{35.9}Co_5B_{1.1}Al_{20}Cu_{10}Zr_5Ga_3Sn_{10}$. Based on 100 weight parts of the total amount of the main phase precursor, the first auxiliary phase precursor and second auxiliary phase precursor, the amount of the first auxiliary phase precursor was 5 weight parts, and the amount of the second auxiliary phase precursor was 7 weight parts. The total composition of the main phase, the first auxiliary phase and the second auxiliary phase was $Pr_{7.32}Nd_{22.01}Dy_{3.27}Tb_{0.54}Fe_{60.82}Co_{1.67}B_{1.01}Al_{1.4}Cu_{0.7}Zr_{0.35}Ga_{0.21}Sn_{0.7}$.

Embodiment 15

The present embodiment E15 provides a rare earth permanent magnetic material and a method of preparing the rare earth permanent magnetic material.

Contents of raw materials of the main phase, the first auxiliary phase and the second auxiliary phase referred to those in Embodiment 14 (i.e., Pr, Nd, Dy, Tb, Ho, Fe, Co, B, Al, Cu, Zr, Ga, Nb and Sn), and the method for preparing the rare earth permanent magnetic material A15 referred to the method of preparing the rare earth permanent magnetic material from the main phase as described in Embodiment 1 (single alloy method). The total composition of the raw materials was: $Pr_7Nd_{20.9}Dy_{4.7}Tb_{0.54}Fe_{60.82}Co_{1.67}B_{1.01}Al_{1.4}Cu_{0.7}Zr_{0.35}Ga_{0.21}Sn_{0.7}$.

Embodiment 16

The present embodiment E16 provides a rare earth permanent magnetic material and a method of preparing the rare earth permanent magnetic material.

The method for preparing the rare earth permanent magnetic material A16 is substantially the same as that in Embodiment 1, with the following exceptions.

The composition of the first auxiliary phase was $Pr_{13}Nd_{46}Dy_7Tb_2Fe_{30.9}B_{1.1}$, and the composition of the second auxiliary phase was $Pr_1Nd_5Dy_4Fe_{35.9}Co_5B_{1.1}Al_{20}Cu_{10}Zr_5Ga_3Sn_{10}$. Based on 100 weight parts of the total amount of the main phase precursor, the first auxiliary phase precursor and second auxiliary phase precursors, the amount of the first auxiliary phase precursor was 15 weight parts, and the amount of the second auxiliary phase precursor was 1 weight part.

Comparative Embodiment 5 (CE5)

The rare earth permanent magnetic material CA5 was prepared according to the Embodiment 2 in Chinese Patent Application Publication No. CN102534358A, in which the composition of the raw materials was $Nd_{18.52}Pr_6Dy_{7.5}Tb_{0.8}Fe_{65.78}Cu_{0.4}B_1$.

Tests

The remanence (Br), coercivity (Hcj) and maximum magnetic energy product ((BH)max) of the rare earth permanent magnetic materials A1-A15 and CA1-CA5 were tested at 22° C. according to GB/T 3217-1992 by using a NIM-10000H tester from the national metrology institute (NMI) of China. The results are shown in Table 1.

TABLE 1

| | Br (kGs) | Hcj (kOe) | (BH)max (MGsOe) |
|---|---|---|---|
| A1 | 12.61 | 28.75 | 39.36 |
| CA1 | 12.81 | 25.45 | 40.22 |
| A2 | 12.54 | 29.67 | 38.54 |
| A3 | 12.57 | 29.4 | 38.73 |
| A4 | 12.4 | 32 | 37.69 |
| A5 | 12.68 | 27.83 | 39.41 |
| CA2 | 12.78 | 24.12 | 40.03 |
| CA3 | 12.65 | 23.94 | 39.22 |
| CA4 | 12.61 | 23.3 | 38.97 |
| A6 | 12.3 | 35 | 37.08 |
| A7 | 12.58 | 29.32 | 38.79 |
| A8 | 12.73 | 26.85 | 39.72 |
| A9 | 12.92 | 25.7 | 40.91 |
| A10 | 12.5 | 31 | 38.30 |
| A11 | 12.54 | 29 | 38.54 |
| A12 | 12.53 | 31.7 | 38.48 |
| A13 | 12.63 | 28.62 | 39.1 |
| A14 | 12.6 | 28.86 | 38.91 |
| A15 | 12.57 | 28.5 | 38.73 |
| A16 | 12.47 | 30.84 | 38.11 |
| CA5 | 12.4 | 29.81 | 37.69 |

It can be seen from Table 1 that, the rare earth permanent magnetic material according to embodiments of the present disclosure has improved coercivity with only a little decrease in remanence.

In addition, by comparing Embodiment 2 and Embodiment 3, Embodiment 10 and Embodiment 11, and Embodiment 14 and Embodiment 15, it can be seen that, in the condition of obtaining rare earth permanent magnetic materials having similar performances, the rare earth permanent magnetic material formed by double alloy methods has a reduced dysprosium and/or terbium content than that formed by single alloy methods. In other words, compared with the single alloy method of preparing a rare earth permanent magnetic material, the double alloy method of preparing a rare earth permanent magnetic material may decrease the content of Dy and/or Tb obviously.

Compared with the rare earth permanent magnetic material obtained from comparative embodiment 5, the content of dysprosium in the rare earth permanent magnetic material obtained from Embodiment 16 has decreased by 47.1 wt %, and the content of terbium has decreased by 10 wt %. It can be concluded that the rare earth permanent magnetic material according to embodiments of the present disclosure may obtain a relative higher remanence and a relative higher coercivity, while reducing the content of Dy and/or Tb, and therefore the manufacturing cost of the rare earth permanent magnetic material may be reduced.

It can be seen from Table 1 that, the remanence of the rare earth permanent magnetic materials according to embodiments of the present disclosure ranges from 12.4 kGs to 12.68 kGs, the coercivity of the rare earth permanent magnetic materials according to embodiments of the present disclosure ranges from 27.83 kOe to 32 kOe. Compared with the comparative embodiment 1 (i.e. having no auxiliary phase provided in embodiments of the present application), the maximum remanence decrease of the rare earth permanent magnetic materials obtained from Embodiments 1-5 is 3.2%, but the maximum coercivity increase of the rare earth permanent magnetic materials obtained from Embodiments 1-5 is 25.7%.

In addition, in the condition of obtaining the rare earth permanent magnetic materials having similar performances, the rare earth permanent magnetic material prepared by the double alloy method has decreased Dy and/or Tb contents compared with those obtained by single alloy methods. Further, compared with the conventional rare earth permanent magnetic material obtained from comparative Embodiment 5, the Dy content and the Tb content of the rare earth permanent magnetic material obtained from Embodiment 16 have decreased by 47.1 wt % and 10 wt % respectively. It can be thus concluded that, the rare earth permanent magnetic material according to embodiments of the present disclosure has relatively higher coercivity while ensuring relatively higher remanence. In addition, the Dy and/or Tb content has been obviously decreased, thus reducing the manufacturing cost of the rare earth permanent magnetic material.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that changes, alternatives, and modifications may be made in the embodiments without departing from spirit and principles of the disclosure. Such changes, alternatives, and modifications all fall into the scope of the claims and their equivalents.

What is claimed is:

1. A rare earth permanent magnetic material comprising:

a main phase represented by $R1_{x1}R2_{y1}Fe_{1-x-y1-z1-u1}Co_{z1}B_{u1}$, wherein R1 is at least one element selected from Pr and Nd; R2 is at least one element selected from Dy, Tb and Ho; x1, y1, z1 and u1 are weight percentages, $26\% \le x1+y1 \le 34\%$, $0.01\% \le y1 \le 4\%$, $0 \le z1 \le 6\%$, and $0.78\% \le u1 \le 1.25\%$; and an auxiliary phase separated from or cladding the main phase, comprising a first auxiliary phase and a second auxiliary, wherein the first auxiliary phase is represented by $R3_{x2}R4_{y2}Fe_{1-x2-y2-z2-u2-v1}CO_{z2}B_{u2}M_{v1}$, where R3 is at least one element selected from Pr and Nd; R4 is at least one element selected from Dy, Tb and Ho; M is at least one element selected from Zr, Ga, Cu, Nb, Sn, Mo, Al, V, W, Si, Hf, Ti, Zn, Bi, Ta and In; x2, y2, z2, u2 and v1 are weight percentages, $35\% \le x2+y2 \le 82\%$, $5\% \le y2 \le 42\%$, $0 \le z2 \le 40\%$, $0 \le u2 \le 1.25\%$, and $0 \le v1 \le 10\%$; and the second auxiliary phase is represented by $R5_{x3}R6_{y3}Fe_{1-x3-y3-z3-u3-v2}Co_{z3}B_{u3}M_{v2}$, where R5 is at least one element selected from Pr and Nd; R6 is at least one element selected from Dy, Tb and Ho; M is at least one element selected from Zr, Ga, Cu, Nb, Sn, Mo, Al, V, W, Si, Hf, Ti, Zn, Bi, Ta and In; x3, y3, z3, u3 and v2 are weight percentages, $10\% \le x3+y3 \le 32\%$, $0 \le y3 \le 4.8\%$, $0 \le z3 \le 40\%$, $0.15 \le u3 \le 1.25\%$, and $31\% \le v2 \le 50\%$.

2. The rare earth permanent magnetic material of claim 1, wherein based on the total weight of the main phase and the auxiliary phase, the content of the first auxiliary C1 satisfies: $0<C1\leq 25$ wt %.

3. The rare earth permanent magnetic material of claim 2, wherein based on the total weight of the main phase and the auxiliary phase, the content of the first auxiliary C1 satisfies: $0<C1\leq 15$ wt %.

4. The rare earth permanent magnetic material of claim 1, wherein based on the total weight of the main phase and the auxiliary phase, the content of the second auxiliary C2 satisfies: $0<C2\leq 20$ wt %.

5. The rare earth permanent magnetic material of claim 4, wherein based on the total weight of the main phase and the auxiliary phase, the content of the second auxiliary C2 satisfies: $0<C2\leq 10$ wt %.

6. The rare earth permanent magnetic material of claim 1, wherein $27\%\leq x1+y1\leq 33\%$, $1\%\leq y1\leq 4\%$, $1\%\leq z1\leq 3\%$, and $0.8\%\leq u1\leq 1.1\%$.

7. The rare earth permanent magnetic material of claim 1, wherein $37\%\leq x2+y2\leq 68\%$, $9\%\leq y2\leq 26\%$, $0\leq z2\leq 18\%$, $0\leq u2\leq 1.1\%$, and $0\leq v1\leq 8\%$.

8. The rare earth permanent magnetic material of claim 1, wherein $10\%\leq x3+y3\leq 30\%$, $0\leq y3\leq 4\%$, $5\%\leq z3\leq 18\%$, $0.1\leq u3\leq 1.1\%$, and $31\%\leq v2\leq 48\%$.

* * * * *